United States Patent [19]

Wing

[11] 4,298,093

[45] Nov. 3, 1981

[54] SAWHORSE

[75] Inventor: Harold R. Wing, Springville, Utah

[73] Assignee: Little Giant Industries, Inc., Provo, Utah

[21] Appl. No.: 961,341

[22] Filed: Nov. 16, 1978

[51] Int. Cl.[3] ..... E04G 1/32; F16M 11/00

[52] U.S. Cl. ..... 182/153; 182/184; 182/167

[58] Field of Search ..... 182/153, 184, 167, 166, 182/225, 118, 119; 248/166

[56] References Cited

U.S. PATENT DOCUMENTS

| | | | |
|---|---|---|---|
| 594,303 | 11/1897 | Ward . | |
| 640,211 | 1/1900 | Lyda et al. . | |
| 719,450 | 2/1903 | Ferguson . | |
| 745,320 | 12/1903 | Bruno . | |
| 983,188 | 1/1911 | Walters . | |
| 1,100,823 | 6/1914 | Gordon . | |
| 1,479,628 | 1/1924 | Seger . | |
| 1,587,383 | 6/1926 | Kennett . | |
| 1,603,307 | 10/1926 | Anderson . | |
| 1,974,233 | 9/1934 | Burke . | |
| 1,987,535 | 1/1935 | Morris . | |
| 2,299,584 | 10/1942 | Low . | |
| 2,427,679 | 9/1947 | Larson | 182/153 |
| 2,551,173 | 5/1951 | Sheridan | 182/24 |
| 2,846,761 | 8/1958 | Evans . | |
| 3,085,651 | 4/1963 | Rich . | |
| 3,692,143 | 9/1972 | Kummerlin | 182/167 |
| 3,841,619 | 10/1974 | Hickman . | |
| 3,912,043 | 10/1975 | Brannan . | |
| 4,095,778 | 6/1978 | Wing . | |

FOREIGN PATENT DOCUMENTS

| | | |
|---|---|---|
| 2228045 | 12/1973 | Fed. Rep. of Germany . |

*Primary Examiner*—Reinaldo P. Machado

*Attorney, Agent, or Firm*—H. Ross Workman; Rick D. Nydegger; Drew S. Hamilton

[57] ABSTRACT

An adjustable sawhorse having a work platform removably mounted atop two pairs of side rails. A pair of hinges connect the side rails of each side rail pair at one end thereof. The hinges may be selectively locked or unlocked to accommodate folding and unfolding of the sawhorse from a folded configuration to an upright configuration and vice versa. Each pair of side rails is also slidably mounted on another pair of side rails to accommodate extension thereof. Locking handles are provided for each extensible set of side rails so that they may be locked into one or more extended positions. Steps are mounted between each pair of side rails to enhance the versatility and use of the sawhorse.

12 Claims, 5 Drawing Figures

SAWHORSE

BACKGROUND

1. Field of the Invention

The present invention relates to foldable work platforms, and more particularly to a sawhorse that may be folded or unfolded as desired and which may be vertically adjusted to accommodate various working heights and uneven terrain.

2. The Prior Art

Carpenters and other types of construction workers often use work platforms which are commonly referred to as sawhorses. Sawhorses are typically rigidly constructed from wood and present a wooden work platform upon which boards and the like are placed for cutting and/or fabrication. Often sawhorses are constructed on the job site because of their awkward shape and the attendant difficulty with which they are transported.

Foldable work platforms for use as extensible support stands and surfaces for work pieces are well-known in the art. For example, see U.S. Pat. No. 4,031,981 and the reference cited therein.

Although foldable work platforms such as those noted above may work well in many applications, there are nevertheless some situations where they do not work well. For example, at times it may be desirable to use a sawhorse for purposes of standing on the sawhorse. Foldable platforms such as those noted above typically have tubular frameworks which are complicated in structure and are not sufficiently stable to be able to stand on them.

And even for those types of sawhorses that are sturdy enough for purposes of standing on them, typically one must make a very long step to get atop the sawhorse. This may present additional inconvenience and danger to a worker when stepping up or when stepping down from the sawhorse.

An additional problem is the common practice of cutting through the sawhorse as boards thereon are being cut. When cut through, the sawhorse is worthless and another must be constructed. This results in lost time and increased cost in materials.

Furthermore, it is oftentimes necessary to use a sawhorse on uneven terrain, or for jobs which would require propping the sawhorse up to accommodate a higher working level.

Accordingly, what is needed is a sawhorse which may be folded and unfolded and which may also be vertically adjusted to accommodate any desired working height or uneven terrain. It would be a further advancement in the art to provide a foldable and vertically adjustable sawhorse having a frame which is sufficiently rigid and having steps mounted thereon to permit a user to easily climb up and stand on the workhorse. It would be a further advancement in the art to provide a workhorse having a removable work platform which may be changed when the old platform becomes worn or damaged. Such an invention is described and claimed herein.

BRIEF SUMMARY AND OBJECTS OF THE INVENTION

The present invention relates to an improved sawhorse having a metal frame that is foldable into a generally flat storage configuration and which may be unfolded and locked into an upright standing configuration. The sawhorse includes a replaceable wooden work platform and legs which may be vertically extended to adjust the height of the sawhorse to any desired working height or to accommodate uneven terrain. Steps are provided on the frame of the workhorse to permit a worker to easily climb up and down on the sawhorse.

Accordingly, it is an object of the present invention to provide an improved sawhorse.

Another object of the present invention is to provide a sawhorse having a replaceable wooden work platform for the working surface thereof.

Yet a further object of the present invention is to provide a sawhorse having legs which may be vertically extended to adjust the working height of the work platform.

Yet a further object of the present invention is to provide an adjustable sawhorse having steps mounted on the legs thereof so as to permit a worker to easily climb up and down on the sawhorse.

Yet another object of the present invention is to provide a sawhorse which may be locked into a folded, flat storage configuration and which may be unfolded and locked into an upright, standing configuration.

These and other objects and features of the present invention will become more fully apparent from the following description and appended claims taken in conjunction with the accompanying drawing.

DETAILED DESCRIPTION OF THE PREFERRED EMBODIMENT

Figure 1:
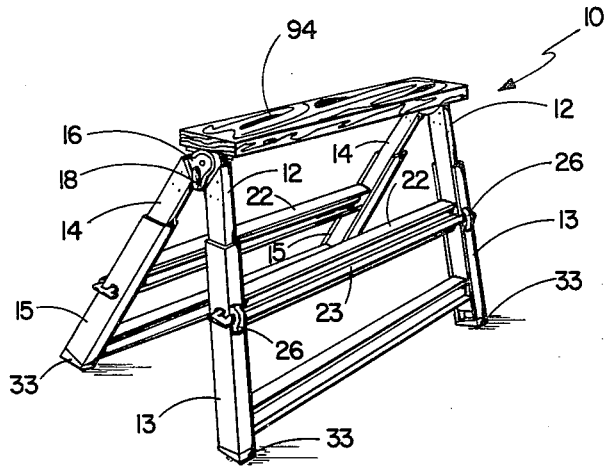
FIG. 1 is a perspective illustration of the sawhorse of the present invention illustrated in an unfolded, upright configuration.

The invention is best understood by reference to the drawing wherein like parts have like numerals throughout.

In FIG. 1, the sawhorse generally designated 10 is shown in an unfolded, upright configuration. Sawhorse 10 is constructed from four pairs of side rails 12–15. As will be hereinafter more fully described, side rail pairs 12 and 14 are hingedly connected at one end by hinges 16 and 17. At their other end side rail pairs 12 and 14 are each slidably mounted in telescopic relation within side rail pairs 13 and 15 respectively. Although each of the side rail pairs 12–15 could be made from any suitable wood or metal material, side rail pairs 12–15 of the illustrated embodiment are preferably formed from extruded aluminum because of its light weight, strength and durability. Non-skid rubber shoes 33 are attached to the surface-engaging ends of side rails 13 and 15 to prevent the sawhorse 10 from slipping when in an upright position.

Hinges 16 and 17 which connect side rail pairs 12 and 14 contain a spring-loaded locking mechanism (not shown) which permits the sawhorse 10 to be locked into both an unfolded, upright configuration and a folded, storage configuration. For example, by rotating levers 18 and 19 of the hinges 16 and 17, the locking mechanism (not shown) of hinges 16 and 17 is released and sawhorse 10 may then be folded and relocked into a flat, storage configuration as illustrated by the broken line portion of FIG. 3.

Hinges such as those illustrated in the preferred embodiment are known in the art and are available through Little Giant Industries Inc., 31 South 100 West, American Fork, Utah. Other types of equally suitable hinges are also known in the art and clearly, any suitable type of hinge could be substituted for hinges 16 and 17.

Figure 2:
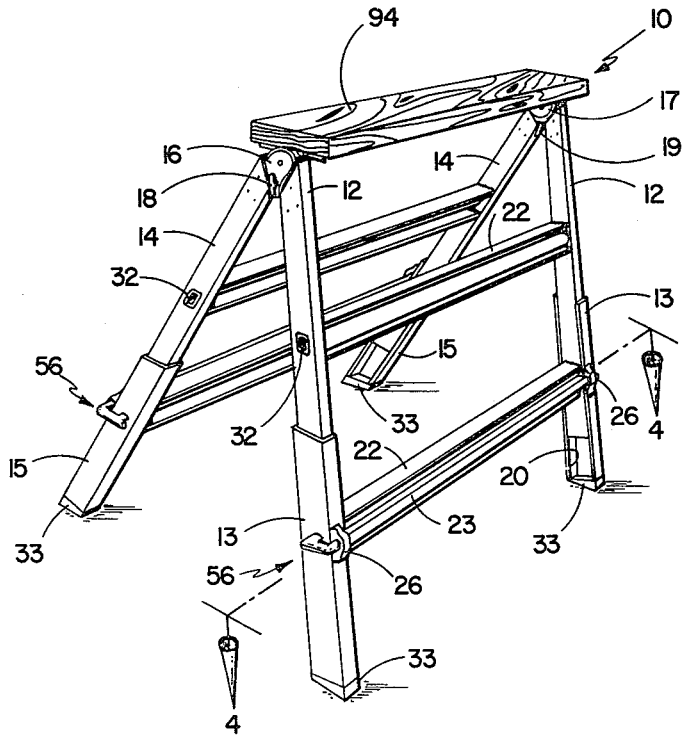
FIG. 2 is a perspective illustration of the sawhorse of FIG. 1 illustrating the side rails of the sawhorse in a vertically extended position.

With continued reference to FIGS. 1 and 2, it will be seen that side rail pairs 12 and 14 are telescopically mounted within side rail pairs 13 and 15 respectively. The side rails of side rail pairs 12 and 14 are preferably of a hollow, rectangular configuration. Each of the side rails of side rail pairs 13 and 15 are extruded so as to form a U-channel as illustrated at 20 in FIG. 2. The U-channels formed in side rails 13 and 15 slidably receive the side rails of side rail pairs 12 and 14.

As will be hereinafter more fully described, each of the side rail pairs 12 and 14 may be independently telescopically extended. It will thus be appreciated that by providing for independent extension of either of the side rail pairs 12 or 14, the sawhorse 10 may be vertically adjusted to accommodate various types of uneven terrain when using the sawhorse 10.

A first type of step 22 is mounted between side rails 12 and 14 while a second type of step 23 is mounted between side rails 13 and 15. The steps 23 are welded or otherwise suitably joined to the outside surfaces of the side rails of side rail pairs 13 and 15 in order to permit telescopic extension of side rail pairs 12 and 14 together with steps 22 mounted therebetween. Protective plastic end covers such as illustrated at 26 are snapped onto each of the ends of each of the steps 23 in order to protect persons working around the ladder from the sharp edges and corners of the steps 23.

Figure 5:
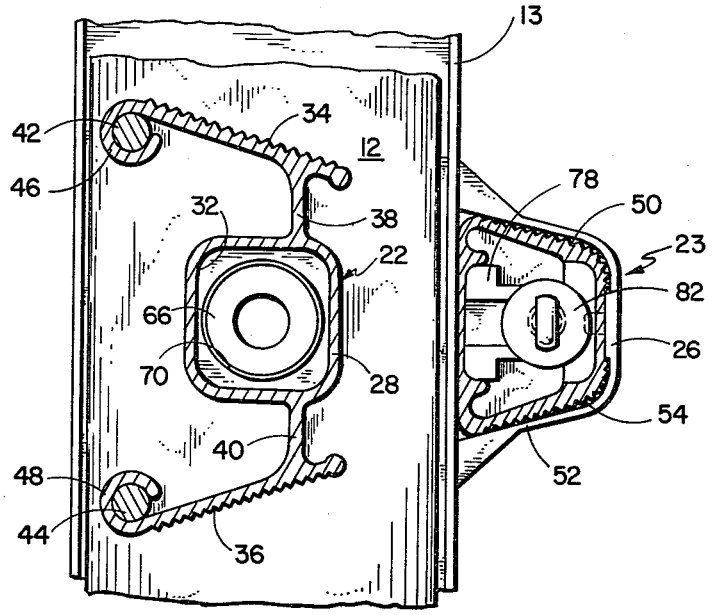
FIG. 5 is a fragmentary cross-sectional illustration particularly showing the construction of the steps that are mounted to the side rails of the sawhorse.

With reference to FIG. 5, it will be seen that the steps 22 each have a hollow bar 28 which extends between the side rails of side rail pairs 12 and 14. Bar 28 is long enough to extend through holes (not shown) provided in each of the side rails of side rail pairs 12 and 14. The ends of the hollow bar 28 are swaged as illustrated in FIG. 2 in order to secure the steps 22 between the side rail pairs 12 and 14. Furthermore, since the bar 28 is hollow, holes 32 are formed along the outside surfaces of the side rails of side rail pairs 12 and 14. As hereinafter more fully described, the holes 32 provide incremental positions at which the side rail pairs 12 and 14 may be locked when vertically extended with respect to the corresponding side rail pairs 13 and 15.

With further reference to FIG. 5, it will be seen that the steps 22 are extruded so as to form two flat surfaces 34 and 36. As shown in FIG. 5, surface 34 faces upwardly while surface 36 faces downwardly. Each of the surfaces 34 and 36 are integrally joined at one end to the tubular bar 28 by brackets 38 and 40. At their other ends, surfaces 34 and 36 are supported by rods 42 and 44 which extend from the side rails of side rail pair 12. Ends 46 and 48 of surfaces 34 and 36 are bent so that they wrap around the rods 42 and 44, thus insuring secure attachment thereto.

The ladder steps 23 which are mounted to the outer edges of the side rail pairs 13 and 15 each have a generally trapezoidal cross-sectional shape, being extruded in the form of a tubular bar. Surfaces 50 and 52 are angled so as to be essentially coplanar with the surfaces 34 and 36 of the steps 22. Thus, when step 23 is vertically aligned with step 22, the steps 23 and 22 jointly form upper and lower surfaces which are coplanar and which are angularly oriented with respect to the side rail pairs 12–15 so that whenever the sawhorse 10 is placed in an upright position, a horizontal stepping surface will be formed by the upward surfaces of the two steps 23 and 22.

Serrations such as that illustrated at 54 may be formed on the surfaces of the steps 22 and 23 to prevent slipping. Alternatively, rubber padding or other non-skid surfaces may be applied to the surfaces of the steps 22 and 23.

Although the steps 22 and 23 described above may be advantageously used with the sawhorse 10 of the present invention, clearly any suitable type of step may be mounted between the side rails of side rail pairs 12–15 of sawhorse 10.

As previously indicated, side rail pairs 12 and 14 may be vertically extended and locked in increments which correspond to the holes 32 formed along the outer edges of side rail pairs 12 and 14. As will be hereinafter more fully described, locking mechanisms such as that generally designated at 56 are mounted on each of the side rail pairs 13 and 15. Since each of the locking mechanisms 56 are identical, for ease of illustration only the locking mechanism 56 associated with side rail pair 13 will be described.

Figure 4:
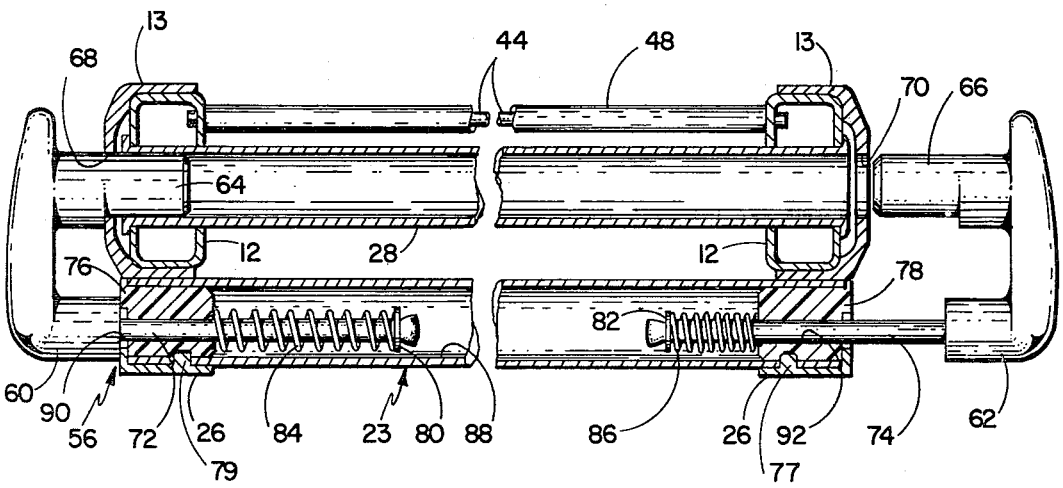
FIG. 4 is a cross section taken along line 4—4 of FIG. 2, and illustrates the locking mechanism used in conjunction with the vertically extensible side rails.

With reference to FIG. 4, it will be seen that locking mechanism 56 has two handles 60 and 62. Handles 60 and 62 have pins 64 and 66 which project through openings 68 and 70 in the side rails of side rail pair 13. Shafts 72 and 74 extend from handles 60 and 62 through openings 90 and 92 provided in end caps 26 and into the hollow 88 of the step 23. Shafts 72 and 74 project through nylon grommets 76 and 78. Nylon grommets 76 and 78 are secured by retaining pins 77 and 79 formed on end caps 26. Flanges 80 and 82 are formed at the ends of shafts 72 and 74 for purposes of retaining springs 84 and 86 as described further below.

As shown by handle 60 at the left hand side of FIG. 4, spring 84 pushes at one end against the nylon grommet 76 and pushes against the flange 80 of shaft 72 at the other end. Since the grommet 76 is secured by retaining pin 77, spring 84 exerts a force on flange 80 which causes the pin 64 of handle 60 to remain locked within the opening 32 of side rail 12.

When it is desired to release the locking mechanism 56 so as to permit telescopic extension of the side rail pair 12, the handles 60 and 62 are pulled out as illustrated by handle 62 on the right side of FIG. 4. As shown by handle 62, when the handles are pulled out, spring 86 is compressed between the nylon grommet 78 and the flange 82 at the end of shaft 74 so as to permit the pin 66 to be withdrawn from the opening 32. With handles 60 and 62 pulled out in this manner, side rail pair 12 is then advanced to the next step so as to vertically extend the side rail pair 12 with respect to the side rail pair 13 (see FIG. 2). In order to relock the side rail pair 12 once it has been vertically extended with respect to the side rail pair 13, the handles 60 and 62 are simply released and the spring 86 then forces the shaft 74 and pin 66 back into the locked position as illustrated by handle 60.

As previously indicated, the locking mechanisms 56 associated with the side rail pairs 12 and 14 can be independently released and locked. This advantageously permits the side rail pairs 12 and 14 to be vertically extended independent of one another, thus increasing the versatility of the sawhorse 10.

Figure 3:
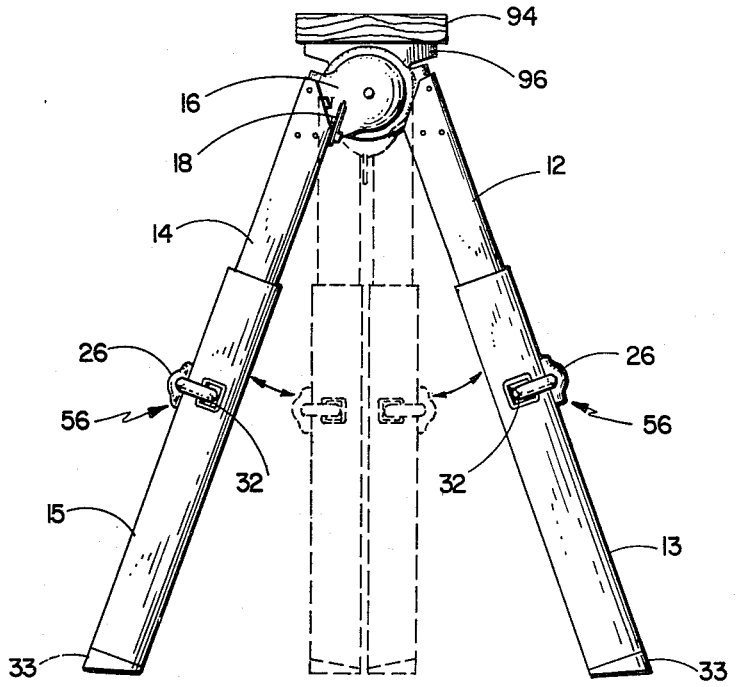
FIG. 3 is a side elevational view of the sawhorse of the present invention which includes a broken line illustration of the sawhorse in a folded configuration.

With further reference to FIGS. 1–3, it will be seen that a wooden work platform 94 is mounted on top of the hinges 16 and 17 which join the side rail pairs 12 and 14. The wooden work platform 94 presents a horizontal working surface for supporting boards or other work pieces when cutting or otherwise working on the work pieces.

As shown best in FIG. 3, metal brackets such as that illustrated at 96 are welded or otherwise securely joined to each of the hinges 16 and 17. The wooden work piece 94 is screwed or otherwise removably joined to the brackets 96 so as to permit the work platform 94 to be removed when it becomes worn or otherwise damaged.

From the foregoing description, it will be appreciated that the sawhorse 10 of the present invention may be advantageously unfolded and locked into an upright configuration or folded and locked into a flat, storage configuration. Furthermore, the sawhorse of the present invention may be vertically extended to accommodate various working heights. The sawhorse of the present invention further provides the additional advantage of a sturdy frame which has provided thereon steps for climbing up or down from the sawhorse when it is desired to stand on the sawhorse. It will further be appreciated that the work platform of the sawhorse of the present invention may be easily removed and replaced when it becomes worn or damaged.

The invention may be embodied in other specific forms without departing from its spirit or essential characteristics. The described embodiment is to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A sawhorse comprising in combination:

a first pair of side rails;

a second pair of side rails hingedly connected to one end of said first pair of side rails to accommodate folding and unfolding of said sawhorse from a folded configuration wherein said side rail pairs are in a side by side position, to an upright configuration and vice versa;

means for locking said first and second side rail pairs in one of said folded or upright configurations;

a third pair of side rails slidably mounted on said first pair of side rails to accommodate vertical extension thereof;

a fourth pair of side rails slidably mounted on said second pair of side rails to accommodate vertical extension thereof;

at least one step mounted between said first side rail pair and at least one step mounted between said third side rail pair;

first means connected to the step mounted between said third side rail pair for locking said third pair of side rails in one or more vertically extended positions relative to said first side rail pair, said first locking means comprising means adapted to be locked into holes formed in the sides of said first side rail pair, said holes being positioned such that the steps mounted between said third side rail pair may be locked into alignment with the steps mounted between said first side rail pair;

second means connected to the step mounted between said fourth side rail pair for locking said fourth pair of side rails in one or more vertically extended positions relative to said second side rail pair; and a work platform removably mounted atop said first and second side rail pairs.

2. A sawhorse as defined in claim 1 further comprising at least one step mounted between said second side rail pair and at least one step mounted between said fourth side rail pair.

3. A sawhorse as defined in claim 1 wherein said means adapted to be locked into said holes comprise a spring-loaded locking handle.

4. A sawhorse as defined in claim 1 wherein the surface-engaging ends of said third and fourth side rail pairs comprise a non-skid shoe.

5. A sawhorse as defined in claim 1 wherein said work platform comprises a wooden board.

6. A sawhorse as defined in claim 1 wherein the side rails of each said first and second side rail pair comprise a hollow, rectangular cross-section rail formed from a light weight metal, and wherein the side rails of each said third and fourth side rail pair comprise a U-channel cross-section rail formed from said light weight metal.

7. A sawhorse comprising in combination:

a first pair of side rails;

a second pair of side rails hingedly connected to one end of said first pair of side rails to accommodate folding and unfolding of said sawhorse from a folded configuration wherein said side rail pairs are in a side by side position, to an upright configuration and vice versa, each of said first and second side rail pairs comprising a hollow, rectangular cross-section configuration formed from a light weight metal;

means for locking said first and second side rail pairs in one of said folded or upright configurations;

a third pair of side rails slidably mounted on said first pair of side rails to accommodate vertical extension thereof;

a fourth pair of side rails slidably mounted on said second pair of side rails to accommodate vertical extension thereof, each of said third and fourth side rail pairs comprising a U-channel cross-section rail formed from said light weight metal;

at least one step mounted between said third side rail pair and at least one step mounted between said fourth side rail pair;

first means connected to the step mounted between said third side rail pair for locking said third pair of side rails in one or more vertically extended positions relative to said first side rail pair;

second means connected to the step mounted between said fourth side rail pair for locking said fourth pair of side rails in one or more vertically extended positions relative to said second side rail pair; and a work platform mounted atop said first and second side rail pairs.

8. A sawhorse comprising in combination:

a first pair of side rails;

a second pair of side rails hingedly connected at one end thereof to one end of said first pair of side rails to accommodate folding and unfolding of said sawhorse from a folded configuration wherein said side rail pairs are in a side by side position, to an upright configuration wherein said pairs of side rails are spaced apart at an angle, and vice versa;

a pair of hinges joining each of the side rails of said first and second side rail pairs, each said hinge comprising means for locking said first and second side rail pairs in one of said folded or upright configurations;

a third pair of side rails slidably mounted on said first pair of side rails to accommodate vertical extension thereof;

a fourth pair of side rails slidably mounted on said second pair of side rails to accommodate vertical extension thereof;

at least one step mounted between said first side rail pair and at least one step mounted between second side rail pair;

at least one step mounted between said third side rail pair and at least one step mounted between said fourth side rail pair;

a first spring-loaded locking handle connected to the step mounted between said third side rail pair and adapted to be locked into holes formed in the sides of the side rails of said first side rail pair and a second spring-loaded locking handle connected to the step mounted between said fourth side rail pair and adapted to be locked into holes formed in the sides of the side rails of said second side rail pair;

a work platform; and means for removably mounting said work platform atop said first and second side rail pairs.

9. A sawhorse as defined in claim 8 wherein the surface-engaging ends of side rails of each said side rail pair comprise a non-skid shoe.

10. A sawhorse as defined in claim 8 wherein said work platform comprises a wooden board.

11. A sawhorse as defined in claim 8 wherein the side rails of each said first and second side rail pair comprise a hollow, rectangular cross-section rail formed from a light weight metal and wherein the side rails of each said third and fourth side rail pair comprise a U-channel cross-section rail formed from said light weight metal.

12. A sawhorse as defined in claim 9 wherein said holes are positioned such that the steps mounted between said third and fourth side rail pairs may be locked into alignment with the steps mounted between said first and second side rail pairs.

* * * * *